US005879579A

United States Patent [19]

Yoshino et al.

[11] Patent Number: 5,879,579

[45] Date of Patent: Mar. 9, 1999

[54] SUBMERGED NOZZLE CHANGE DEVICE

[75] Inventors: Ryoichi Yoshino, Bizen; Kenji Yamamoto, Sanyo-cho; Tadao Taniguchi; Noritaka Hashimoto, both of Bizen, all of Japan

[73] Assignee: Shinagawa Refractories Co., Ltd., Tokyo, Japan

[21] Appl. No.: 926,134

[22] Filed: Sep. 9, 1997

[30] Foreign Application Priority Data

Sep. 12, 1996 [JP] Japan ..... 8-242167
Sep. 30, 1996 [JP] Japan ..... 8-258251

[51] Int. Cl.[6] ..... B22D 41/56

[52] U.S. Cl. ..... 222/606; 266/DIG. 1

[58] Field of Search ..... 222/591, 597, 222/606, 607, 594; 266/236, DIG. 1

[56] References Cited

U.S. PATENT DOCUMENTS

| | | | |
|---|---|---|---|
| 5,173,199 | 12/1992 | Bruckner et al. | 222/606 |
| 5,351,865 | 10/1994 | Szadkowski et al. | 222/607 |
| 5,665,264 | 9/1997 | Sato et al. | 222/607 |
| 5,688,425 | 11/1997 | Yamamoto et al. | 222/606 |

FOREIGN PATENT DOCUMENTS

| | | |
|---|---|---|
| 1006191A3 | 6/1994 | Belgium . |
| 0467220A1 | 7/1990 | European Pat. Off. . |
| 0468363A1 | 7/1990 | European Pat. Off. . |

*Primary Examiner*—Scott Kastler
*Attorney, Agent, or Firm*—Koda & Androlia

[57] ABSTRACT

A submerged nozzle change device has a slide valve unit 3 which is provided in a molten-metal outlet formed in a lower portion of a molten-metal containing vessel 1 for controlling the outflow of a molten metal. A pair of guide rails 26 for slidably suspending and supporting a holding case 6 mounted on an upper end of a submerged nozzle 5 are swingably supported on the slide valve unit 3 so that one end of each of the guide rails can be pivotally moved upwards and downwards about a shaft 21 while being biased upwards. On the free ends of the guide rails 24, there is provided a pushing cylinder 30 for pushing a new submerged nozzle 51 set on the guide rails 26 to push an old submerged nozzle 52 to the opposite side. A pair of guide rollers 35, which are moved by a piston rod 30*a* of the pushing cylinder 30, are brought into contact with the upper surfaces of the guide rails 26 to hold the guide rails 26 horizontally until a nozzle hole 52*b* of the old submerged nozzle 52 is out of register with a nozzle hole 11*a* of the slide valve unit 3 to close the nozzle hole 11*a* of the slide valve unit 3. An inclined cam 27 is provided for moving the guide rails 26 downwards until the new submerged nozzle 51 reaches the lower surface of the slide valve unit 3 after the nozzle hole 11*a* is closed. Thus, it is possible to provide a submerged nozzle change device which can quickly change a submerged nozzle and which can prevent the contact surface of a submerged nozzle from being scratched when a new submerged nozzle is caused to slide to move to a predetermined position.

9 Claims, 11 Drawing Sheets

SUBMERGED NOZZLE CHANGE DEVICE

BACKGROUND OF THE INVENTION

1. Field of the Invention

The present invention relates generally to a submerged nozzle change device or a change device for submerged nozzles. More specifically, the invention relates to a change device for a submerged nozzle used for allowing a molten metal to run out of a molten-metal containing vessel.

2. Description of the Prior Art

An example of a conventional submerged nozzle change device is shown in FIG. 13A. As shown in a vertical section of FIG. 13A, an insert nozzle 2 is inserted into a molten-metal outlet formed in the bottom of a molten-metal containing vessel 1, such as a tundish or a ladle. A slide valve unit 3 is arranged directly below the insert nozzle 2. The slide valve unit 3 has an upper plate 4 having a through hole 4*a*. The lower portion of the insert nozzle 2 is formed on the upper plate 4 of the slide valve unit 3 around the through hole 4*a*. A submerged nozzle 5 is arranged directly below the slide value unit 3. The periphery of the upper portion of the submerged nozzle 5 is covered with a metal case 6, so that the submerged nozzle 5 is suspended from and supported on a submerged-nozzle supporting unit 7 via the metal case 6.

As shown in FIG. 18, in the case of a continuous casting apparatus, the lower portion of the submerged nozzle 5 is submerged in a mold 8 having a water-cooled structure, so that a molten metal 9 flows continuously into the mold 8 through an outlet 5*a* formed in the periphery of the lower portion of the submerged nozzle 5. The peripheral surface of the molten metal 9 is cooled in the mold 8, so that the molten metal 9 is solidified therein. Then, the solidified molten metal 9 is drawn out from the lower portion of the mold 8 to be led to the next process.

As shown in FIG. 13A, the slide valve unit 3 also has a slide plate 10 having a through hole 10*a*. The slide plate 10 is connected to a piston rod of a hydraulic cylinder (not shown in FIG. 13A) to slide in horizontal directions (in directions perpendicular to the plane of FIG. 13A) by means of the hydraulic cylinder. In addition, the slide valve unit 3 has a lower plate 11 having a through hole 11*a*. When the slide plate 10 slides in horizontal directions by means of the hydraulic cylinder, the hole 10*a* of the slide plate 10 is brought into and out of register with the hole 4*a* of the upper plate 4 and the hole 11*a* of the lower plate 11 to establish and block a fluid communication so as to control the outflow of the molten metal.

The upper end portion of the submerged nozzle 5 is formed as an enlarged-diameter portion which is covered with the case 6 of a metal. The upper-end contact surface of the submerged nozzle 5 is brought into tight contact with the lower surface of the lower plate 11. Since the lower plate 11 may be a lower nozzle, the lower plate 11 will be referred to hereinafter as a lower nozzle 11.

As mentioned above, the lower portion of the submerged nozzle 5 is always submerged in the molten metal in the mold 8. Therefore, wear and damage of the lower portion of the submerged nozzle 5 may be caused by the molten metal, so that it is required to timely change the submerged nozzle 5 to a new submerged nozzle 51.

Therefore, as shown in FIGS. 13A, 13B and 14, the conventional submerged nozzle change device is provided with a pair of rails 12, which are provided on both sides of the submerged-nozzle supporting unit 7 arranged below the slide valve unit 3 and which can slidably support the submerged nozzle 5 thereon. After the new submerged nozzle 51 is set between the pair of rails 12, the new submerged nozzle 51 is pushed as shown in FIG. 15 by means of a piston rod 13*a* of a hydraulic or pneumatics pressing cylinder 13 supported on the lower surface of the molten-metal vessel 1, whereupon a spent submerged nozzle (which will be hereinafter referred to as an old submerged nozzle 52) is moved to the opposite side of the rails 12, from where the old submerged nozzle 52 is removed.

Furthermore, as can be seen from FIGS. 13A and 14, the submerged-nozzle supporting unit 7 has two sets of supporting members 14 on the right and left sides. Each set of supporting members 14 are oscillatably supported on the lower surface of the slide valve unit 3 at the intermediate portions thereof via a shaft 15. A plurality of springs 16 are provided between the upper surfaces of the outer end portions of the respective supporting members 14 and the lower surface of the slide valve unit 3, so that the inner end portions of the respective supporting members 14 are biased upwards. Thus, the upper-end contact surface of the submerged nozzle 5 suspended between the supporting members 14 is brought into tight contact with the lower surface of the lower nozzle 11 to be fixed thereto.

According to the above described conventional submerged nozzle change device, the time required to change the submerged nozzle 5 may be short, and the time to stop the outflow of the molten metal may be short in the case of the continuous casting. Therefore, there are advantages in that the scrapping of the molten metal can be reduced and the yield thereof can be improved.

However, in the conventional submerged nozzle change device, when the submerged nozzle 5 is changed, the upper-end contact surface of the new submerged nozzle 51 is caused to slide on the lower surface of the lower nozzle 11 to a predetermined position while a surface pressure is being applied to the upper-end contact surface of the new submerged nozzle. In addition, a seal member, such as a packing, can not be used. Therefore, the upper-end contact surface of the new submerged nozzle 51 may easily be scratched to produce gaps between the upper-end contact surface of the new submerged nozzle 51 and the lower surface of the lower nozzle 11 so that air is allowed to enter through the gaps and the molten metal is oxidized.

In particular, if a metal 17 is adhered to the inner periphery of the old submerged nozzle 52 and solidified as shown in FIG. 16, the metal 17 is difficult to be cut even if the new submerged nozzle 51 is pushed by the piston rod 13*a* of the cylinder 13 to move out the old submerged nozzle 52. Even if the metal 17 is cut, the cut metal 17 projects from the lower nozzle 11 as shown in FIG. 17. In this state, if the new submerged nozzle 51 is caused to slide on the lower nozzle 11, the upper-end contact surface of the new submerged nozzle 51 will be scratched and impair the degree of tight contact of the new submerged nozzle 51 with the lower nozzle 11.

SUMMARY OF THE INVENTION

It is therefore an object of the present invention to eliminate the aforementioned problems and to provide a submerged nozzle change device, which can quickly change a submerged nozzle and which can prevent the contact surface of a new submerged nozzle from being scratched, to avoid impairing the degree of tight contact of the contact surface of the new submerged nozzle with the lower nozzle, and to prevent air from entering the new submerged nozzle.

In order to accomplish the above and other objects, according to the present invention, a submerged nozzle change device comprises: slide valve means provided in a molten-metal outlet formed in a lower portion of a molten-metal containing vessel, for controlling outflow of a molten metal; guide rail means provided below the slide valve means, for supporting a holding case, which is mounted on an upper end of a submerged nozzle, so as to be slidable in a horizontal direction; pushing means for pushing, from one end of the guide rail means toward the other end thereof, a new submerged nozzle, which is supported on the one end of the guide rail means via the holding case, toward an old submerged nozzle, which is supported on the guide rail means at a position directly below a molten-metal discharging hole of the slide valve means, to cause the old submerged nozzle to slide from a position corresponding to the molten-metal discharging hole so as to cause the new submerged nozzle to be positioned directly below the molten-metal discharging hole; detecting means for detecting that the new submerged nozzle is pushed by the pushing means to move along the guide rail means to a position substantially below the molten-metal discharging hole of the slide valve means; and depressing means for lowering the new submerged nozzle supported on the guide rail means, in response to detection by the detecting means.

The detecting means may be a depressing member which moves forwards with the pushing means when the pushing means pushes a new submerged nozzle, and the depressing means may comprise: means for pivotably supporting the other end of the guide rail means so as to allow the one end of the guide rail means to be depressed; and an inclined cum, provided on the one end of the guide rail means, for allowing the depressing means to depress the one end of the guide rail means when the depressing means moves forwards to a predetermined position.

According to the present invention, the submerged nozzle change device may further comprise a swingable lever extending along the guide bar means, the swingable lever being pivotably supported on the guide rail means at an intermediate portion thereof, and the swingable lever having a first end at the one end and a second end at the other end, each of the new and old submerged nozzles having an engaging portion on the holding case thereof, the second end being brought into contact with the engaging portion of the old submerged nozzle to be depressed so as to form the detecting means when the new submerged nozzle is pushed by the pushing means to move along the guide rail means to a position nearly below the molten-metal discharging hole of the slide valve means so as to push the old submerged nozzle to a position out of register with a position directly below the molten-metal discharging hole, the first end being normally located at a pushed-up position at which the first end is brought into contact with the engaging portion of the holding case for the submerged nozzle from the bottom to move the submerged nozzle upwards on the guide rail means toward the slide valve means, and the first end being depressed from the pushed-up position so as to form the depressing means when the second end is moved upwards by the engaging portion of the old submerged nozzle to cause the swingable lever to pivot.

BRIEF DESCRIPTION OF THE DRAWINGS

The present invention will be understood more fully from the detailed description given herebelow and from the accompanying drawings of the preferred embodiments of the invention.

In the drawings.

DESCRIPTION OF THE PREFERRED EMBODIMENTS

Referring now to the accompanying drawings, particularly to FIGS. 1 through 12, preferred embodiments of a submerged nozzle change device, according to the present invention, will be described below. Furthermore, the same reference numbers are used for the same elements as those of FIG. 13A.

Figure 1:
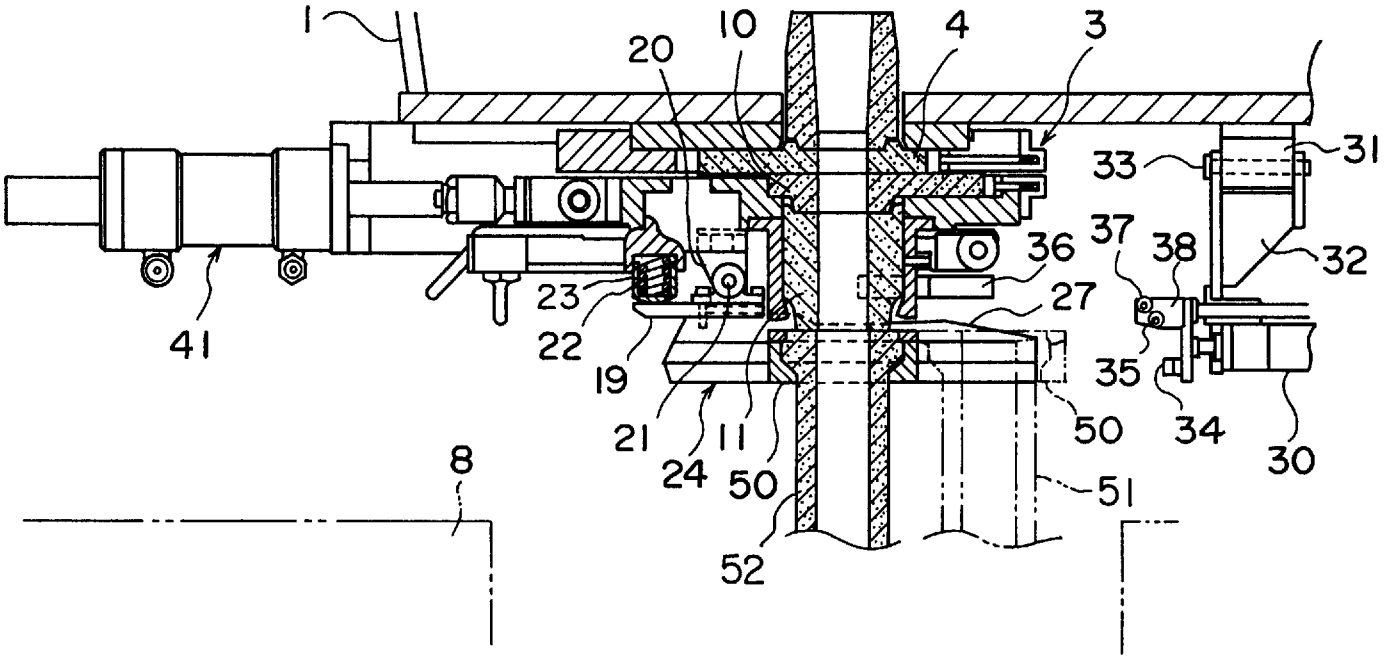
FIG. 1 is a sectional view of a first preferred embodiment of a submerged nozzle change device according to the present invention.
Figure 2:
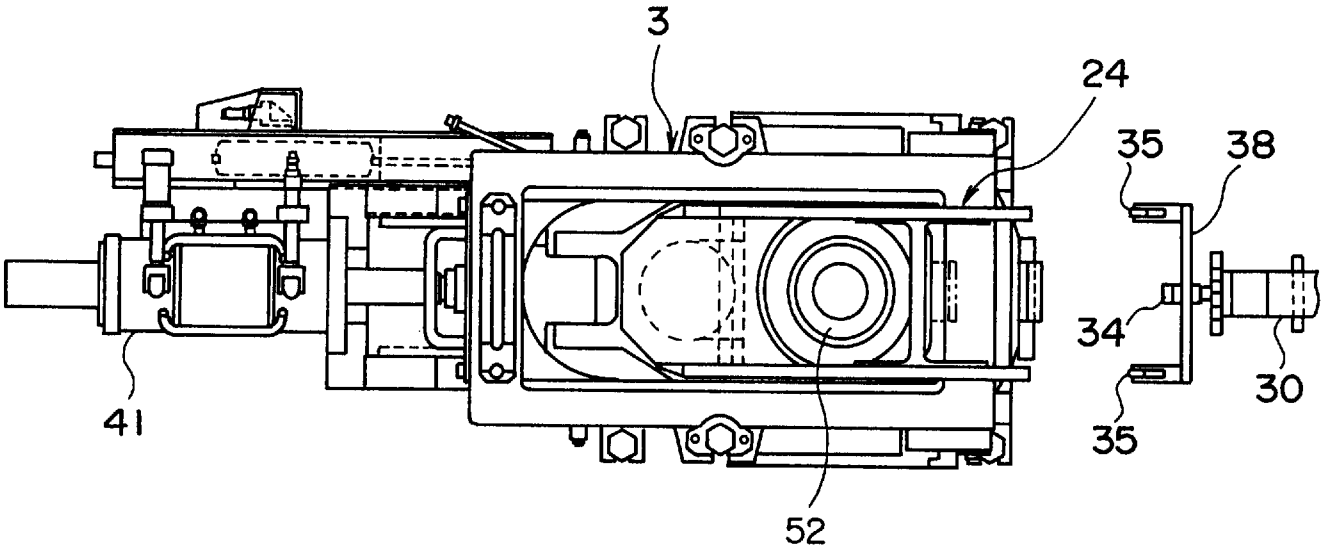
FIG. 2 is a bottom view of the submerged nozzle change device of FIG. 1.

FIG. 1 is a sectional view of a first preferred embodiment of a submerged nozzle change device according to the present invention. FIG. 2 is a bottom view of the submerged nozzle change device of FIG. 1, and FIG. 3 is an enlarged sectional view of a principal part thereof.

In this preferred embodiment, a slide valve unit 3 has a lower nozzle 11. On one side of the lower nozzle 11, an arm base 19 is supported on a shaft 21 of a bearing portion 20 mounted on the slide valve unit 3, so as to be oscillatable upwards and downwards. Between the lower surface of the slide valve unit 3 and the opposite end of the arm base 19 to the lower nozzle 11, a compression coiled spring 22 serving as an elastic body is provided via a spring holder 23, to bias the arm base 19 so as to urge the arm base 19 about the shaft 21 counterclockwise as viewed in FIGS. 1 and 3.

Figure 3:
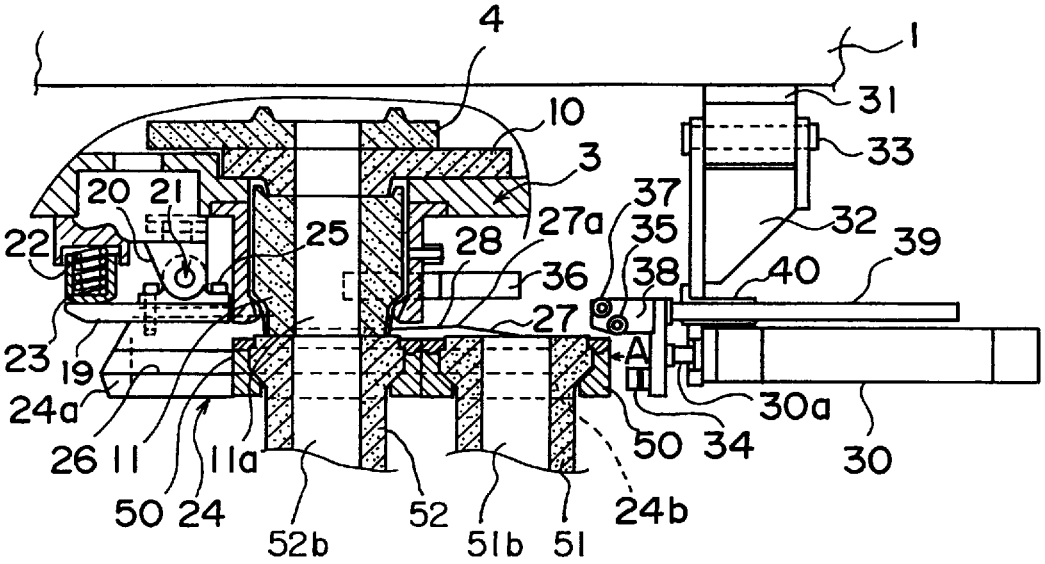
FIG. 3 is an enlarged sectional view of a principal part of the submerged nozzle change device of FIG. 1.
Figure 4:
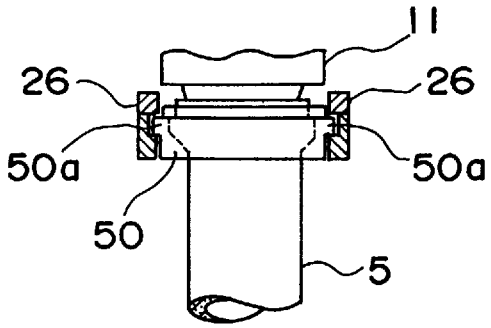
FIG. 4 is a sectional view of a part of the submerged nozzle change device of FIG. 1.

As shown in FIG. 3, a proximal portion 24*a* of a guide bar unit 24 for suspending and supporting a submerged nozzle 5 is fixed to the arm base 19 by means of a bolt 25 or the like. The guide bar unit 24 has a pair of parallel guide rails 26 facing each other at an interval. As shown in FIG. 4, the guide rails 26 engage a projecting portion (or a flange portion) 50*a* of a holding case 50, which engages the enlarged-diameter upper portion of a submerged nozzle 5 to hold the submerged nozzle 5, so that the holding case 50 is slidably supported on the guide rails 26. The length of the guide bar unit 24 is designed so that the guide bar unit 24 can engage and support at least three holding cases 50. The longitudinally intermediate portion of the guide bar unit 24 is positioned so as to extend from one side to the other side of the lower end of the lower nozzle 11.

The upper surface of the guide bar unit 24 is formed with an inclined cam 27 having an inclined surface 28, which is inclined upwards from the tip portion 24*b* to the proximal end 24*a* thereof and slightly downwards from a top 27*a*.

A pushing cylinder 30 is provided so as to face the tip portion 24*b* of the guide bar unit 24. The pushing cylinder 30 is supported, via a supporting bracket 32, on a fixed base 31 secured to the lower surface of the molten-metal vessel 1. The supporting bracket 32 is pivotably supported on the fixed base 31 by means of a pin 33. When a new submerged nozzle 51 is to be set on the tip portion 24*b* of the guide bar unit 24, the pushing cylinder 30 can pivot about the pin 33 to move upwards and sidewise.

On the tip portion of a piston rod 30*a* of the pushing cylinder 30 are mounted via a bracket 38 a pushing member 34 for pushing the holding case 50 of a new submerged nozzle 51, a first guide roller 35 for contacting the inclined cam 27 of the guide bar unit 24, and a second guide roller 37 for contacting the lower surface of a guide base 36 fixed to the slide valve unit 3. Behind the pivots of the guide rollers 35 and 37, a guide rod 39 is arranged so as to extend in parallel to the longitudinal axis of the pushing cylinder 30. The guide rod 39 passes through a bearing 40 of the supporting bracket 32 to prevent the rotation of the piston rod 30*a* while allowing the piston rod 30*a* to smoothly move in longitudinal directions.

The positional relationship between the inclined cam 27 of the guide bar unit 24 and the guide rollers 35 and 37 are as follows. That is, when the new submerged nozzle 51 set on the tip portion 24*b* of the guide bar unit 24 is pushed by the pushing member 34 of the pushing cylinder 30 so that the nozzle hole 52*b* of an old submerged nozzle 52 is shifted from the registered position with a nozzle hole 11*a* of the lower nozzle 11 to close the lower nozzle 11, the second guide roller 37 contacts the lower surface of the guide base 36 and the first guide roller 35 contacts the front end (initially contacting end) of the inclined cam 27 of the guide bar unit 24.

As shown in FIG. 1, a hydraulic cylinder 41 is provided for sliding the slide plate 10 horizontally as is known in the art.

Referring to FIGS. 3, 4 and 5A through 5C, the operation of the above described first preferred embodiment of a submerged nozzle change device, according to the present invention, will be described below.

In a case where the submerged nozzle 5 is to be changed, the pushing cylinder 30 is pivotally moved sidewise about the pin 33 of the supporting bracket 32 thereof so that the guide rails 26 of the guide bar unit 24 are allowed to received and support the projecting portion 50*a* of the holding case 50 of a new submerged nozzle 51 as shown in FIG. 4. Thus, the new submerged nozzle 51 is set at the position shown in FIG. 3.

Then, the pushing cylinder 30 is pivotally moved downwards to its regular position, and then pushing cylinder 30 is actuated to thrust out the piston rod 30*a* so that the holding case 50 of the new submerged nozzle 51 is pushed by the pushing member 34 provided on the tip of the piston rod 30*a*. Thus, the new submerged nozzle 51 is moved to the left as viewed in FIG. 3 along the guide rails 26 of the guide bar unit 24.

Figure 5A:
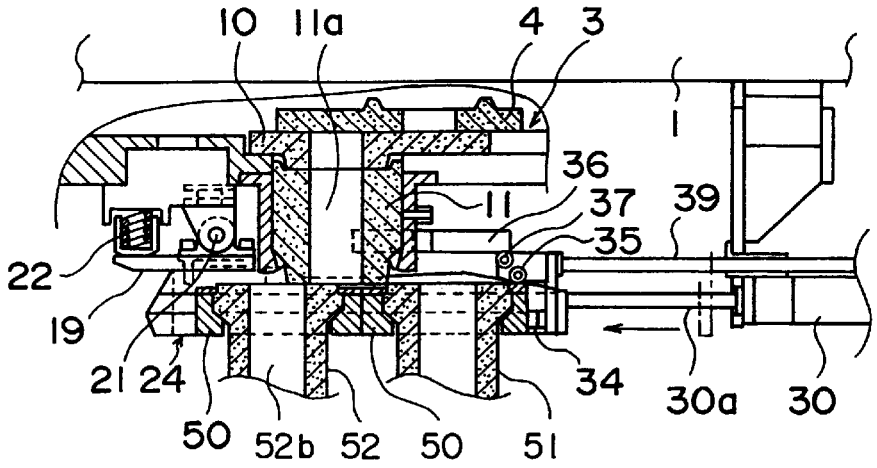
FIGS. 5A, 5B and 5C are sectional views showing steps of changing a submerged nozzle.

Thus, as shown in FIG. 5A, when the old submerged nozzle 52 is moved to a position at which the nozzle hole 52*b* of the old submerged nozzle 52 is out of register with the nozzle hole 11*a* of the lower nozzle 11 to close the lower nozzle 11, the first guide roller 35 serving as depressing means, which moves with the piston rod 30*a*, is positioned at the front end (initially contacting end) of the inclined cam 27 formed on the upper surface of the guide bar unit 24, while the second guide roller 37 is positioned below the guide base 36.

Figure 5B:
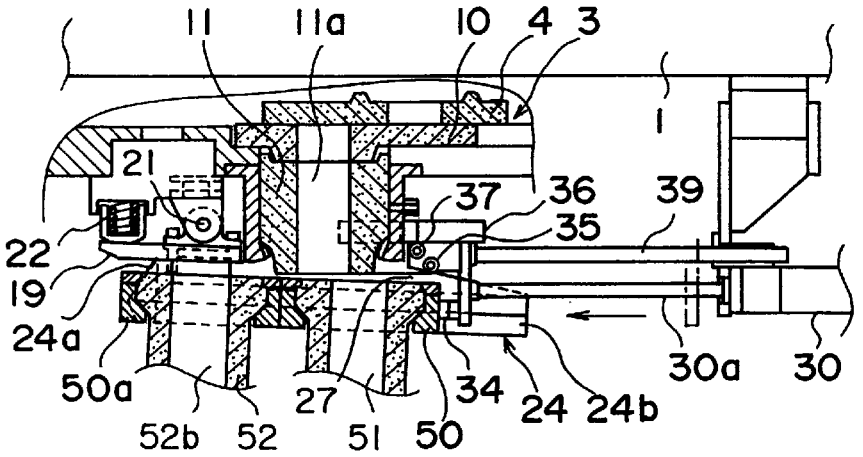
Figure 5C:
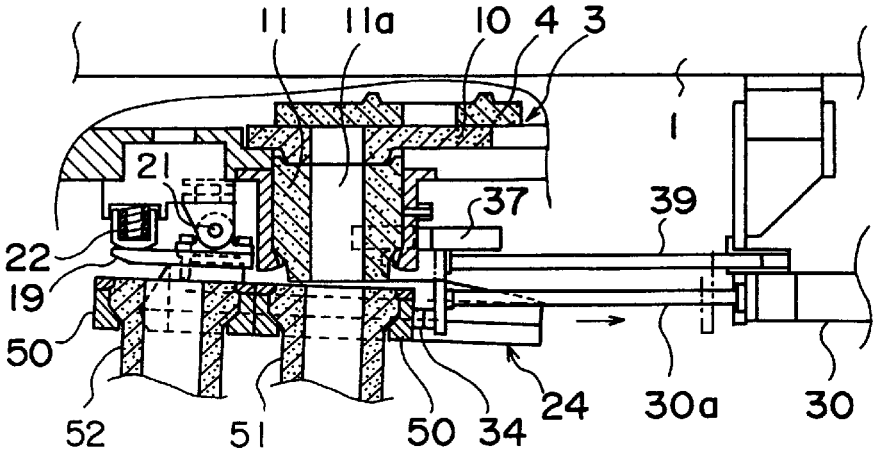

When the piston rod 30*a* is further extended, the first guide roller 35 serving as depressing means depresses the guide bar unit 24 via the inclined cam 27 so that the guide bar unit 24 pivots about the shaft 21 against the biasing force of the compression spring 22 as shown in FIG. 5B. Thus, a gap is formed between the upper-end contact surface of the new submerged nozzle 51 and the lower surface of the lower nozzle 11. In this state, as shown in FIG. 5C, the new submerged nozzle 51 is moved to the position immediately below the lower nozzle 11, and the old submerged nozzle 52 is moved to the left end of the guide bar unit 24 in FIG. 5C and becomes ready for removal therefrom.

Thereafter, when the piston rod 30*a* is pulled back, the depressing force created by the guide rollers 35 and 37 is released to allow the pivotal movement of the guide bar unit 24 upwards about the shaft 21 by the biasing force of the compression spring 22, so that the upper-end contact surface of the new submerged nozzle 51 is brought into tight contact with the lower end surface of the lower nozzle 11 to complete the mounting of the new submerged nozzle 51.

Figure 13A:
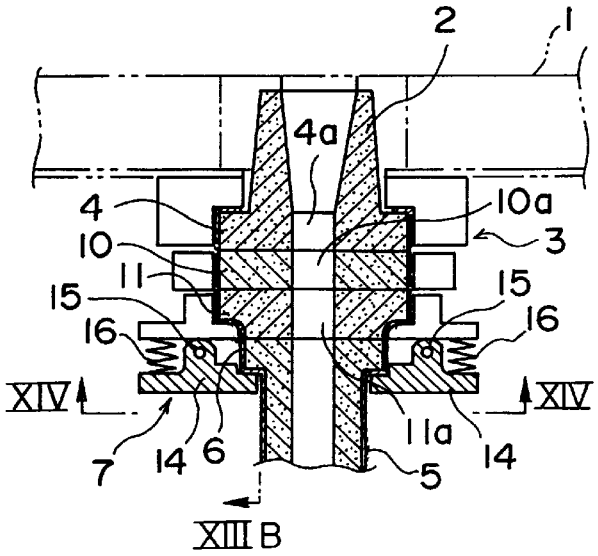
PRIOR ART FIG. 13A
FIG. 13A is a sectional view of a conventional submerged nozzle change device.
Figure 13B:
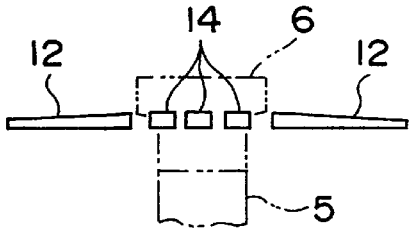
PRIOR ART FIG. 13B
FIG. 13B is a sectional view of the conventional submerged nozzle change device taken along line XIIIB—XIIIB of FIG. 13A.
Figure 14:
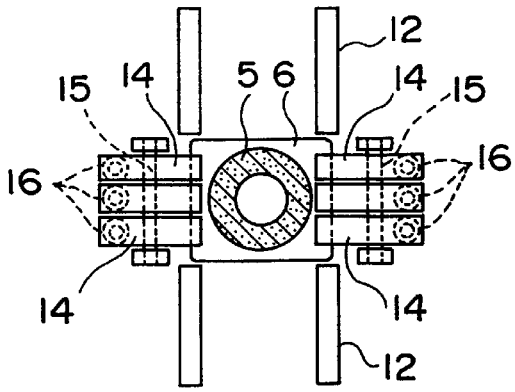
PRIOR ART FIG. 14
FIG. 14 is a sectional view of the conventional submerged nozzle change device taken along line XIV—XIV of FIG. 1.
Figure 15:
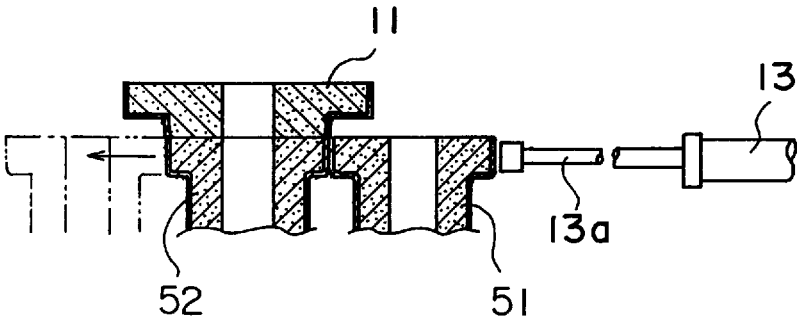
FIG. 15 PRIOR ART
FIG. 15 is a view showing a conventional process for changing a submerged nozzle.
Figure 16:
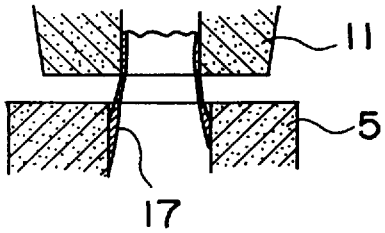
FIG. 16 PRIOR ART
FIG. 16 is a view illustrating a state wherein a metal is adhered to the inner surface of a hole of a nozzle.
Figure 17:
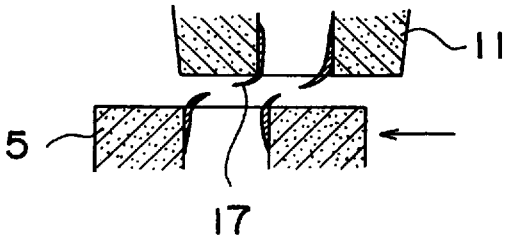
FIG. 17 PRIOR ART
FIG. 17 is a view illustrating a state wherein a metal is cut in the conventional submerged nozzle change device.
Figure 18:
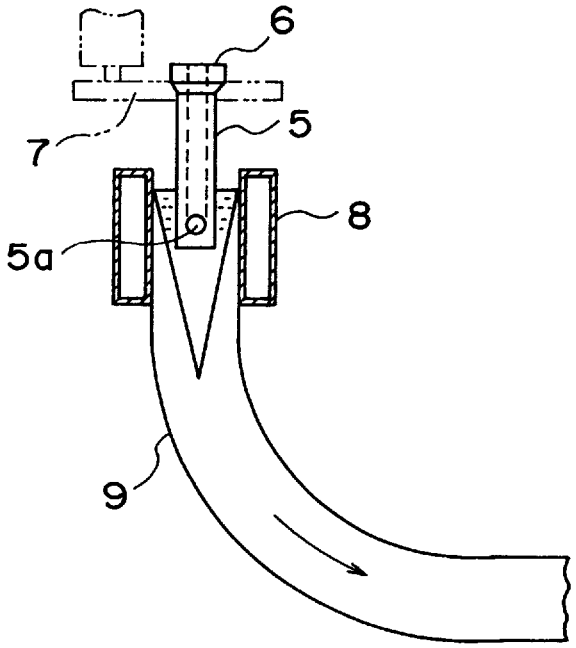
FIG. 18 PRIOR ART
FIG. 18 is a view showing the relationship between a continuous casting aparatus and a submerged nozzle.

Furthermore, while the submerged nozzle 5 has had no metal case in the embodiment shown, the periphery of a sub5 merged nozzle may be covered with a metal case 6 as shown in FIGS. 13A and 13B.

According to the above described first preferred embodiment, while a new submerged nozzle is being slid to a position corresponding to the lower end surface of the lower nozzle, an old submerged nozzle is caused to slide while contacting the lower end surface of the lower nozzle. Therefore, even if a metal is adhered to the inner surface of the nozzle, it is possible to reliably cut the metal without leaving the factor of preventing close contact of the upper-end contact surface of the new submerged nozzle to the lower end surface of the lower nozzle. In addition, when a new submerged nozzle is moved to the position corresponding to the lower end surface of the lower nozzle, the inclined cam prevents the new submerged nozzle from frictionary contacting the lower end surface of the lower nozzle. Therefore, it is possible to prevent the upper-end contact surface of the new submerged nozzle from frictionally being scratched, whereby the sealing can be remarkably improved, and the time required to change the submerged nozzle can be greatly.

A second preferred embodiment of a submerged nozzle change device, according to the present invention, will be described below.

Figure 6:
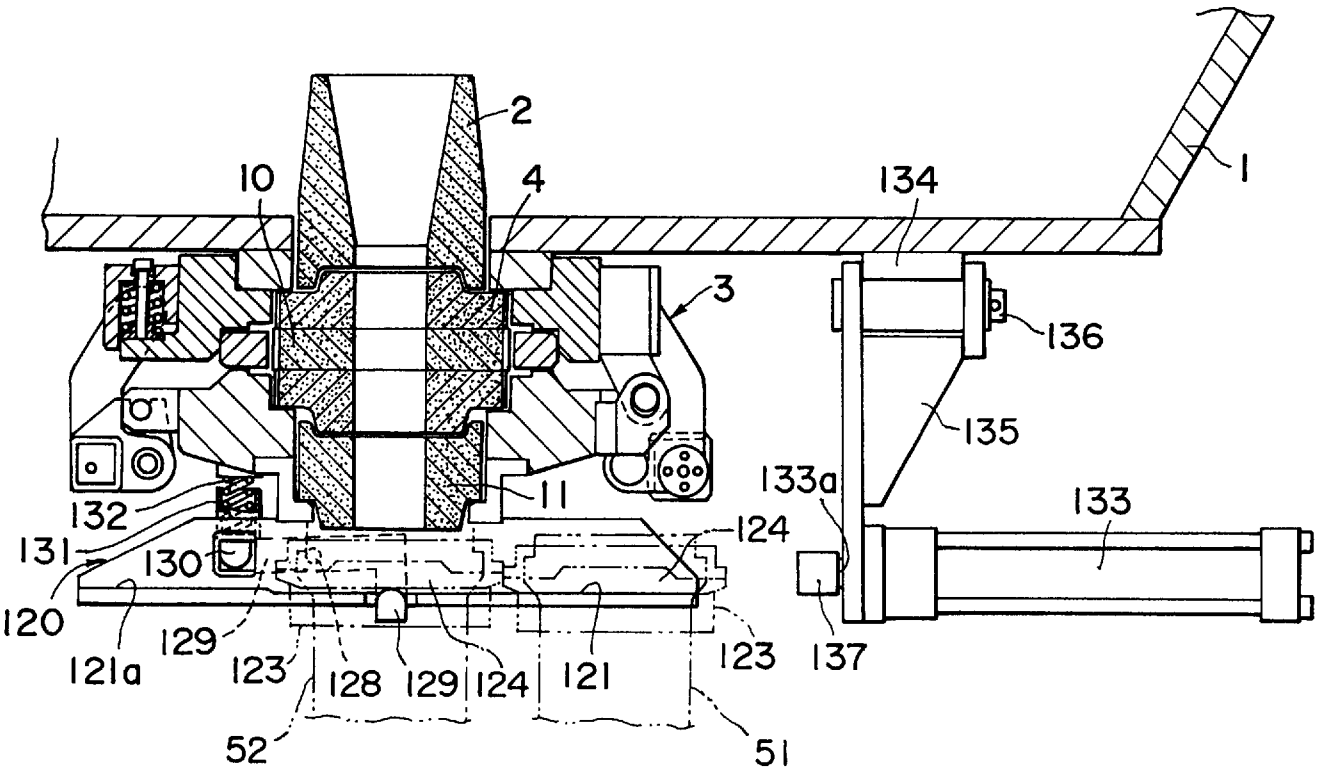
FIG. 6 is a sectional view of a second preferred embodiment of a submerged nozzle change device according to the present invention.
Figure 7:
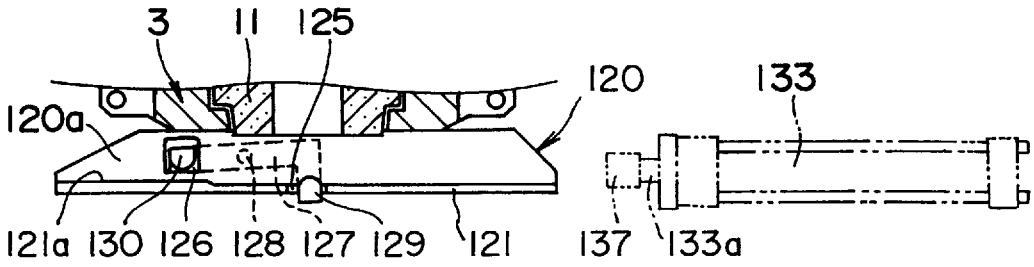
FIG. 7 is an enlarged sectional view of a principal part of the submerged nozzle change device of FIG. 6.
Figure 8:
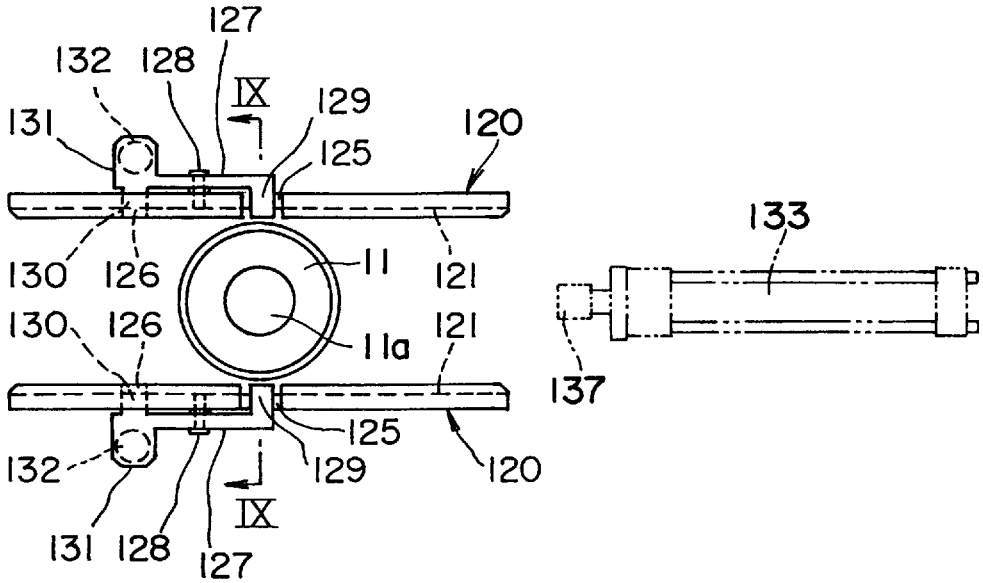
FIG. 8 is a bottom view of FIG. 7.
Figure 9:
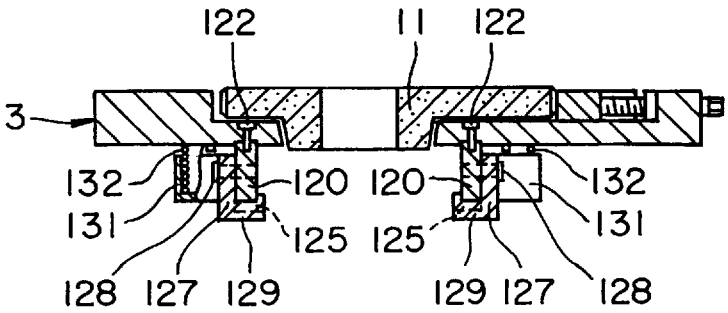
FIG. 9 is a sectional view taken along line IX—IX of FIG. 8.
Figure 10:
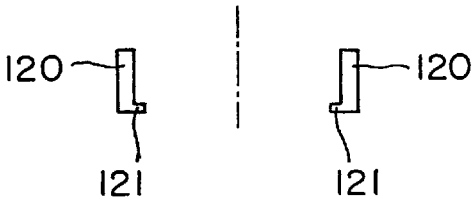
FIG. 10 is a front view of guide rails.

FIG. 6 is a vertical sectional view schematically illustrating a submerged nozzle change device using a three-layer type lower nozzle, and FIG. 7 is an enlarged sectional view of a principal part of the device of FIG. 6. FIG. 8 is a bottom view of FIG. 7, and FIG. 9 is a sectional view taken along line IX—IX of FIG. 8.

Also in the second embodiment, a slide value unit 3 has a lower nozzle 11, and a pair of parallel guide rails 120 of a guide bar unit are arranged so as to face each other on both sides of the lower portion of the lower nozzle 11. As can be clearly seen from FIG. 10, each of the guide rails 120 has a supporting portion 121 at the lower end thereof to have a L-shaped cross section. As shown in FIG. 9, the guide rails 120 are arranged so that the supporting portions 121 face each other. The guide rails 120 are secured to the lower surface of the slide valve unit 3 by means of screws 122. When a submerged nozzle 5 is inserted into a space between the supporting portions 121, the lower surfaces of engaging portions 124 (which will be described later), which are formed on both sides of a submerged-nozzle holding case 123 arranged on the upper end of the submerged nozzle 5, engage the supporting portions 121 to be slidably supported thereon. The distance between the upper surfaces of the supporting portions 121 and the lower surface of the lower nozzle 11 is slightly greater than the distance (or height) between the upper end surface of the submerged nozzle 5 and the lower surfaces of the engaging portions 124 of the holding case 123.

Each of the guide rails 120 is formed with a recessed portion 125(FIG. 8) in the lower surface thereof at a position corresponding to the vertical axis of the lower nozzle 11. Also, each of the side walls 120*a* of the guide rails 120 is formed with a through hole 126 towards the end thereof from where the submerged nozzle is removed.

On the outer surface of each of the side walls 120*a* of the guide rails 120, a swingable lever 127 extending between the recessed portion 125 and the through hole 126 is mounted substantially at an intermediate portion thereof by means of a pin 128 so as to be swingable about the pin 128. Each of the swingable lever 127 has a first laterally projecting portion 129 at one end thereof, and a second laterally projecting portion 130 at the other end thereof on the side of the lower nozzle 11. Each of the first projecting portions 129 is adapted to engage the corresponding recessed portion 125, and each of the second projecting portions 130 is adapted to engage the corresponding through hole 126. Each of the first projecting portions 129 has a rounded upper surface, and each of the second projecting portions 130 has a rounded lower surface.

As can be seen from FIG. 7, the supporting portion 121 of each of the guide rails 120 has a slightly raised portion 121*a* which extends from the end thereof on the submerged-nozzle removal side to a position beyond the through hole 126.

Each of the swingable lever 127 is provided with pushing means at the end thereof on the side of the through hole 126. In the embodiment shown, the pushing means comprises a pair of spring holders 131 provided on the respective swingable lever arms 127, and a pair of compression springs 132 supported on the spring holders 131. Each of the compression springs 132 contacts the lower surface of the slide valve unit 3 to constantly bias the corresponding first projecting portion 129 upwards.

Figure 11A:
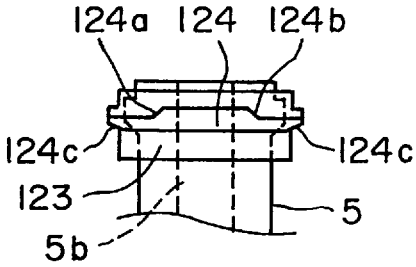
FIG. 11A is a side view of a holding case.
Figure 11B:
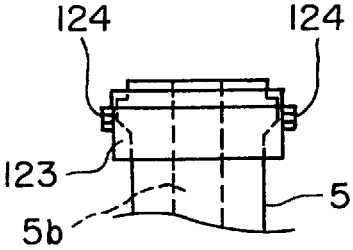
FIG. 11B is a front view thereof.

A side of the holding case 123 is shown in FIG. 11A, and a front view thereof is shown in FIG. 11B. As shown in FIGS. 11A and 11B, the holding case 123 has a rectangular shape, and engaging portions 124 project from both sides of the holding case 123. As can be seen from FIG. 11A, each of the engaging portions 124 has a first tapered portion 124*a* and a second tapered portion 124*b* on the upper surface thereof, and a pair of tapers 124*c* on both ends of the lower surface thereof. The tapers 124*c* are designed to allow the engaging portions 124 to smoothly engage the supporting portions 121 of the guider rails 120. The upper surface of each of the engaging portions 124 engages the corresponding second projecting portion 130 of the swingable lever 127, and the lower surface of each of the engaging portions 124 engages the corresponding first projecting portion 129 of the swingable lever.

Therefore, when the first projecting portions 129 engage the engaging portions 124 of the holding case 123 of the submerged nozzle 5 supported on the supporting portions 121 of the guide rails 120, the submerged nozzle 5 is moved upwards by the projecting portions 129, so that the upper end surfaces thereof are brought into tight contact with the lower surface of the lower nozzle 11. On the other hand, when the second projecting portions 130 engage the upper surfaces of the engaging portions 124, the submerged nozzle 5 is depressed downwards so that the first projecting portions 129 are positioned at the same level as or at a lower level than those of the upper surfaces of the supporting portions 121.

A pushing cylinder 133 is provided facing the submerged-nozzle insertion ends of the guide rails 120. As shown in FIG. 6, the pushing cylinder 133 is supported, via a supporting bracket 135, on a fixed base 134 secured to the lower surface of a molten-metal containing vessel 1. The supporting bracket 135 is pivotably mounted on the fixed base 134 via a pin 136 so that the pushing cylinder 133 can pivot about the pin 136 upwards sidewise when a new submerged nozzle 51 is set on the submerged-nozzle insertion side of the guide rails 120. The tip of a piston rod 133*a* of the pushing cylinder 133 is provided with a pushing member 137 for pushing the holding case 123 of the new submerged nozzle 51.

Referring to FIGS. 12A through 12F, the operation of the above described second embodiment of a submerged nozzle change device, according to the present invention, will be described below.

Figure 12A:
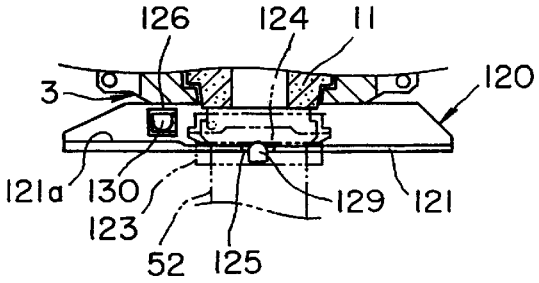
FIGS. 12A through 12F are sectional views showing steps of changing a submerged nozzle.
Figure 12B:
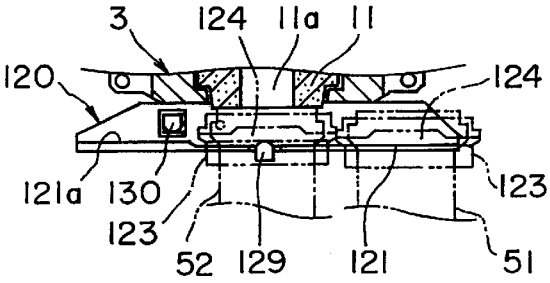
Figure 12C:
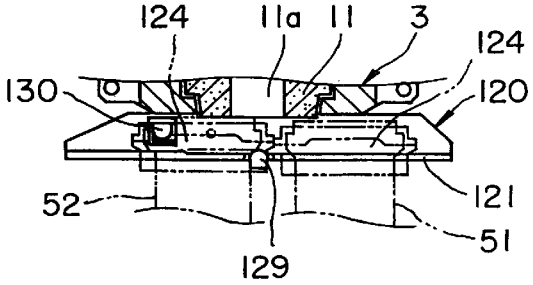

FIG. 12A shows an operating state of the submerged nozzle change device. In this state, the holding case 123 of the submerged nozzle 5 is moved upwards, via the engaging portions 124 thereof, by means of the first projecting portions 129 biased by the compression springs (not shown in FIGS. 12A through 12F), so that the upper-end contact surface of the submerged nozzle 5 is brought into tight contact with the lower surface of the lower nozzle 11.

In a case where the submerged nozzle 5 is changed, the pushing cylinder 133 is pivotally moved sidewise about the pin 136 of the supporting bracket 135 thereof so that the engaging portions 124 of the holding case 123 of the new submerged nozzle 51 can be put on the submerged-nozzle insertion sides of the respective supporting portions 121 of the guide rails 120 as shown in FIG. 6. Thus, the submerged nozzle 5 is set at a position shown in FIGS. 6 and 12B.

Then, the pushing cylinder 133 is pivotally moved downwards to a regular position, and the pushing cylinder 133 is actuated to extend the piston rod 133*a* so that the holding case 123 of the new submerged nozzle 51 is pushed by the pushing member 137 mounted on the tip of the piston rod 133*a*. Thus, the new submerged nozzle 51 is moved along the supporting portions 121 of the guide rails 120 to the left in FIGS. 6 and 12B.

Thus, the old submerged nozzle 52 is pushed toward the submerged-nozzle removal side of the guide rails 120. In a case where a metal is adhered to the inner surface of the nozzle hole and solidified therein, the metal is cut during the movement of the old submerged nozzle 52.

When the old submerged nozzle 52 reaches a closing position at which the nozzle hole 52*b* of the old submerged nozzle 52 is out of register with the nozzle hole 11*a* of the lower nozzle 11, the engaging portions 124 of the holding case 123 rides onto the slightly raised portions 121*a* of the supporting portions 121 of the guide rials 120. Thereafter, the first tapered portions 124*a* of the engaging portions 124 are brought into contact with the second projecting portions 130 of the swingable levers 127 (FIG. 12C) to move the second projecting portions 130 upwards, so that each of the swingable levers 127 pivots about the corresponding pin 128 clockwise in FIG. 12C and the first projecting portions 129 are retracted from the upper surfaces of the supporting portions 121. Thus, the upper-end contact surface of the new submerged nozzle 51 can move without frictionally contacting the lower surface of the lower nozzle 11 (FIG. 12D), so that it is possible to prevent the upper-end contact surface of the new submerged nozzle 51 from being scratched before the new submerged nozzle 51 reaches the position directly below the lower nozzle 11.

Figure 12D:
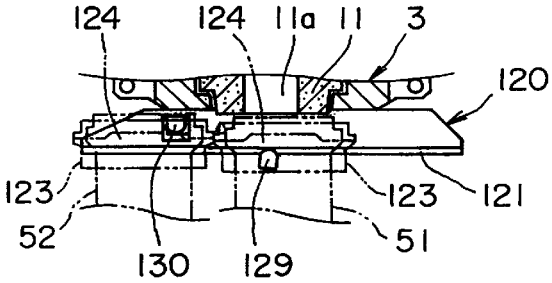
Figure 12E:
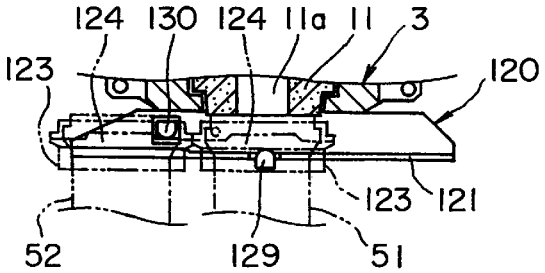
Figure 12F:
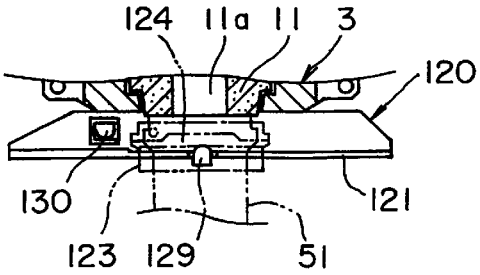

When the new submerged nozzle 51 is positioned directly below the lower nozzle 11, the second projecting portions 130 fall to the second tapered portions 124*b* of the engaging portions 124 of the holding case 123 of the old submerged nozzle 52, whereby the swingable levers 127 are rotated by the biasing force of the compression springs 132 counter-clockwise as viewed in FIG. 12D. Thus, the first projecting portions 129 project from the upper surfaces of the supporting portions 121 of the guide rails 120 again to contact the lower surfaces of the engaging portions 124 of the holding case 123 of the new submerged nozzle 51 to move the engaging portions 124 upwards (FIG. 12E), whereby the upper-end contact surface of the new submerged nozzle 51 is brought into tight contact with the lower surface of the lower nozzle 11. Then, the old submerged nozzle 52 is removed from the submerged-nozzle removal end portions of the guide rails 120 to assume the state shown in FIG. 12F (which is the same as that in FIG. 12A).

A fitting portion may be provided at an intermediate portion of the engaging portion 124 so as to fit the first projecting portion 129 of the swingable lever 127. While the submerged nozzle 5 has had no metal case in the embodiment shown, the periphery of a submerged nozzle may be covered with a metal case 6 as shown in FIGS. 13A and 13B. Moreover, while the compression springs 32 have been provided as means for biasing the swingable levers 127, pneumatic or hydraulic cylinders may be used.

According to the above described second preferred embodiment, when a new submerged nozzle is caused to slide to a position corresponding to the lower end surface of the lower nozzle, an old submerged nozzle is caused to slide while contacting the lower end surface of the lower nozzle. Therefore, even if a metal is adhered to the inner surface of the nozzle, the metal can surely be cut to remove the factor of preventing the close contact of the upper-end contact surface of the new submerged nozzle with the lower end surface of the lower nozzle. Further, when the new submerged nozzle is moved to the position corresponding to the lower end surface of the lower nozzle, the swingable levers can prevent the new submerged nozzle from contacting the lower end surface of the lower nozzle. Therefore, it is possible to prevent the upper-end contact surface of the new submerged nozzle from being scratched, whereby sealing can be remarkably improved, and the time required to change the submerged nozzle is substantially the same as those in conventional devices. Further, since the submerged nozzle is tightly held by the swingable levers and the compression springs, the size of the device can be reduced.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modification to the embodiments shown which can be embodied without departing from the principle of the invention as set forth in the appended claims

What is claimed is:

1. A submerged nozzle change device comprising:

slide valve means, provided in a molten-metal outlet formed in a lower portion of a molten-metal containing vessel, for controlling outflow of a molten metal;

guide rails means provided below said slide valve means, for supporting a holding case, mounted on an upper end of a submerged nozzle, so as to be slidable in a horizontal direction; and pushing means for pushing, from one end of the guide rail means toward the other end thereof, a new submerged nozzle, which is supported on said one end of said guide rail means via said holding case, toward an old submerged nozzle, which is supported on said guide rail means at a position directly below a molten-metal discharging hole of said slide valve means, to cause the old submerged nozzle to slide from a position corresponding to said molten-metal discharging hole so as to cause the new submerged nozzle to be positioned directly below said molten-metal discharging hole;

detecting means for detecting that said new submerged nozzle is pushed by said pushing means to move along said guide rail means to a position substantially below said molten-metal discharging hole of said slide valve means; and depressing means for lowering the new submerged nozzle supported on said guide rail means, in response to detection by said detecting means.

2. The submerged nozzle change device according to claim 1, wherein said detecting means is a depressing member which moves forwards with said pushing means when said pushing means pushes a new submerged nozzle, and wherein said depressing means comprises: means for pivotably supporting said other end of said guide rail means so as to allow said one end of said guide rail means to be depressed; and an inclined cam, provided on said one end of said guide bar means, for allowing said depressing means to depress said one end of said guide rail means when said depressing means moves forwards to a predetermined position.

3. The submerged nozzle change device according to claim 2, wherein said depressing means is a guide roller.

4. The submerged nozzle change device according to claim 2, wherein said depressing means has a guide base for preventing said depressing means to move upwards when said inclined cam allows said depressing means to depress said one end of said guide bar means.

5. The submerged nozzle change device according to claim 2, which further comprises means for biasing said one end of said guide rail means upwards.

6. The submerged nozzle change device according to claim 1, which further comprises a swingable lever extending along said guide rail means, said swingable lever being pivotably supported on said guide bar means at an intermediate portion thereof, said swingable lever having a first end at said one end and a second end at said other end, each of said new and old submerged nozzles having an engaging portion on the holding case thereof, said second end being brought into contact with said engaging portion of said old submerged nozzle to be depressed so as to form said detecting means, when said new submerged nozzle is pushed by said pushing means to move along said guide rail means to a position nearly below said molten-metal discharging hole of said slide valve means so as to push the old submerged nozzle to a position out of register with a position direct below said molten-metal discharging hole, said first end being normally located at a pushed-up position at which said first end is brought into contact with said engaging portion of the holding case for the submerged nozzle from the bottom to move the submerged nozzle upwards on the guide rail means toward said slide valve means, and said first end being depressed from said pushed-up position so as to form said depressing means, when said of said old submerged nozzle to cause said swingable lever to pivot.

7. The submerged nozzle change device according to claim 6, wherein said guide rail means has a supporting portion, on which said engaging portion of the submerged nozzle is supported in a longitudinal direction thereof, said supporting portion having a recessed portion, said first end being movable between a position at which said first end is inserted into said recessed portion, and a position at which said first end projects upwards from said recessed portion.

8. The submerged nozzle change device according to claim 7, wherein said supporting portion of said guide rail means has a raised portion for moving said engaging portion (124) of the submerged nozzle upwards on the side of said other end of said guide bar means.

9. The submerged nozzle change device according to claim 6, wherein said engaging portion of the submerged nozzle has tapered portions on an upper surfaces of both ends thereof.

* * * * *